US005960639A

United States Patent [19]

Hammer

[11] Patent Number: 5,960,639

[45] Date of Patent: Oct. 5, 1999

[54] APPARATUS FOR REGULATING COMPRESSOR CYCLES TO IMPROVE AIR CONDITIONING/REFRIGERATION UNIT EFFICIENCY

[75] Inventor: Jack Hammer, Wantagh, N.Y.

[73] Assignees: Intellidyne, LLC, Wantagh; Harvey Schwartz, Merrick, both of N.Y.

[21] Appl. No.: 08/996,750

[22] Filed: Dec. 23, 1997

Related U.S. Application Data

[60] Provisional application No. 60/035,888, Jan. 23, 1997.

[51] Int. Cl.[6] ..... F25B 49/02

[52] U.S. Cl. ..... 62/158; 62/228.1; 165/269

[58] Field of Search ..... 62/158, 157, 231, 62/228.1, 228.3, 229, 230; 236/46 F; 165/267, 269, 270

[56] References Cited

U.S. PATENT DOCUMENTS

| | | | |
|---|---|---|---|
| 2,477,728 | 8/1949 | Fitz Gerald | 236/46 |
| 3,640,085 | 2/1972 | Harris | 62/158 |
| 3,979,059 | 9/1976 | Davis | 236/46 |
| 3,995,810 | 12/1976 | Banks | 237/8 R |
| 4,094,166 | 6/1978 | Jerles | 62/158 |
| 4,136,730 | 1/1979 | Kinsey . | |
| 4,292,813 | 10/1981 | Paddock | 62/158 |
| 4,453,590 | 6/1984 | Holliday et al. | 236/46 F |
| 4,537,038 | 8/1985 | Alsenz et al. . | |
| 4,850,310 | 7/1989 | Wildgen | 122/446 |
| 5,192,020 | 3/1993 | Shah | 236/46 |
| 5,227,981 | 7/1993 | Katsuki et al. | 62/158 X |
| 5,326,026 | 7/1994 | Jefferson et al. | 236/11 |
| 5,470,019 | 11/1995 | Martensson | 237/19 |

*Primary Examiner*—Harry B. Tanner
*Attorney, Agent, or Firm*—Nolte, Nolte & Hunter

[57] ABSTRACT

To regulate a cooling system operation, a value from an energy value sensor such as a thermostat or pressuretrol is sensed and, if the value warrants a call for compressor operation, the call is made. The last compressor off-call-time is stored in memory. If the off-call-time is less than a short-cycle interval, the compressor is delayed to allow substantial compressor pressure equalization. Compressor operation is delayed further for a percentage of the off-call-time. compressor on-time is also measured and, if on for a substantial interval, the compressor is given a short rest. Improved efficiency results.

19 Claims, 7 Drawing Sheets

APPARATUS FOR REGULATING COMPRESSOR CYCLES TO IMPROVE AIR CONDITIONING/REFRIGERATION UNIT EFFICIENCY

This application claims priority under 35 USC §119(e) of Provisional Patent Application Number 60/035,888, filed Jan. 23, 1997.

A portion of the disclosure of this patent document contains material which is subject to copyright protection. The copyright owner has no objection to the facsimile reproduction by anyone of the patent document or the patent disclosure, as it appears in the Patent and Trademark Office patent file or record, but otherwise reserves all copyright rights whatsoever.

FIELD OF THE INVENTION

The invention relates in general to devices that consume electrical energy in the process of generating a cooling medium used for the purposes of reducing the temperatures within an area requiring reduced temperatures.

This invention is particularly suited to reducing power consumption in refrigeration and air conditioning units.

It is the purpose of this invention to reduce the electrical consumption of the electro-mechanical device (compressor) responsible for the generation of the cooling media, be it gas or liquid, that is being distributed throughout the area to be cooled/refrigerated. This reduction of electrical energy must be accomplished without the undesirable side-effect of causing temperature fluctuations within the controlled environment, beyond those which existed before the installation of the invention.

BACKGROUND OF INVENTION

Air Conditioning/Cooling/Refrigeration systems (hereinafter "refrigeration systems" or "cooling systems"), which utilize compressors, are least efficient when starting up. Prior to reaching optimum running conditions, the average net BTU output of the refrigeration system is below its rated capacity. The optimum run conditions of a refrigeration system are not obtained until all of the component parts of the system have obtained their design operational temperatures. This can take considerable time after the compressor starts because the thermal inertia of each device, which was just off and is relatively hotter than when running, must be overcome. Some of the component parts of a refrigeration system are:

a) Compressor b) Coolant-media (usually refrigerant gas).

c) heat-exchangers:

the evaporator (the heat-exchanger used to absorb heat from the area to be cooled and transfer that heat to the coolant-media); and the Condenser, the heat-exchanger used to release heat from the coolant-media to the external ambient environment.

d) Coolant-media piping.

e) Items within the controlled space which have thermal mass and inertia.

The invention increases the net BTU output of the refrigeration system by cycle control of the compressor. By intelligently increasing the delay between compressor run cycles, (the amount of which has been experimentally proven and to be within reasonable limits) longer more efficient (higher net BTU) output cycles are generated.

In connection with refrigeration systems, it is common knowledge that the output capacities of cooling systems are usually determined by:

a) The worst case scenarios (design-loads) that the systems are expected to encounter.

b) Anticipated future expansions.

c) Expected degradation of the system output due to aging.

Anytime the demand on the cooling system is less than the cooling capacity, the cooling system is over-sized. This "over-sizing" condition exists, within a typical properly designed system, about 85% of the time and causes the cooling system to cycle the compressor in an inefficient and energy consuming fashion.

There is another system scenario that the invention also addresses; that is one where the compressor is undersized and never shuts off. While it would seem that there is no way to save energy, other than to shut the compressor off, the invention does just that. After a predetermined amount of continuous run-time the compressor is stopped for a predetermined amount of time and then restarted. While it would appear to one skilled in the art that this would cause temperature fluctuations, in fact, experimentation with the present invention shows that it has less of an effect than that of a door being opened for that duration of time. The thermal inertia and thermal storage of the items within the controlled space are used, indirectly, as a capacitor of sorts to absorb these thermal transitions and they do just that.

It has also been proven experimentally that while extending the compressor off-time and subsequent lengthening of the on-time increases efficiency, there are certain limitations that the inventor feels must be addressed. In a properly sized refrigeration system (one that is cycling), extending the off-time beyond certain limits will cause temperature fluctuations and also will serve no useful purpose as far as energy reduction. Subsequently, the invention will not allow the extended off-time function to have any effect when the compressor has been off for longer than a predetermined time.

OBJECTS OF THE INVENTION

The present invention seeks to:

A) Reduce the electrical consumption of cooling/refrigeration systems by the modification of compressor run cycles.

B) Provide compressor anti-short-cycling control to enhance compressor life expectancy and to further reduce electric consumption.

The invention, through the use of computer technology, is able to determine the thermodynamic loading imposed upon the compressor, without the need of any additional sensors, and to alter the compressor cycling pattern in such a fashion as to cause the cooling capacity of the system to more closely match the demand of the system. This more efficient ratio of capacity vs. demand causes a more efficient use of each compressor cycle and thereby a reduction of electric consumption.

It is well known in the industry about the effects of short-cycling a compressor. Short-cycling causes undo stress on the compressor as well as much greater than normal electrical demands due to locked-rotor conditions which can occur as a result of non-pressure-equalization within the compressor. This condition is caused by an insufficient time-lapse between when the compressor is stopped and then restarted. Another factor of short-cycling is the excess heat buildup in the motor windings which can be caused by repeated rapid starting of the compressor. To this end, the invention incorporates an anti-short-cycling algorithm as part of its program.

It is therefore desirable for the invention to be an energy saving device capable of being used in cooling energy value sensor (such as a thermostat or pressuretrol) demand type control systems. It is not limited to such applications, but would also be suited for use with energy management systems. This invention would be suitable for new, retrofit and original equipment manufacturer (OEM) installations. It is also the invention's intent to be simple to install and not require any programming or adjustments.

DETAILED DESCRIPTION OF THE DRAWINGS

Figure 1A:
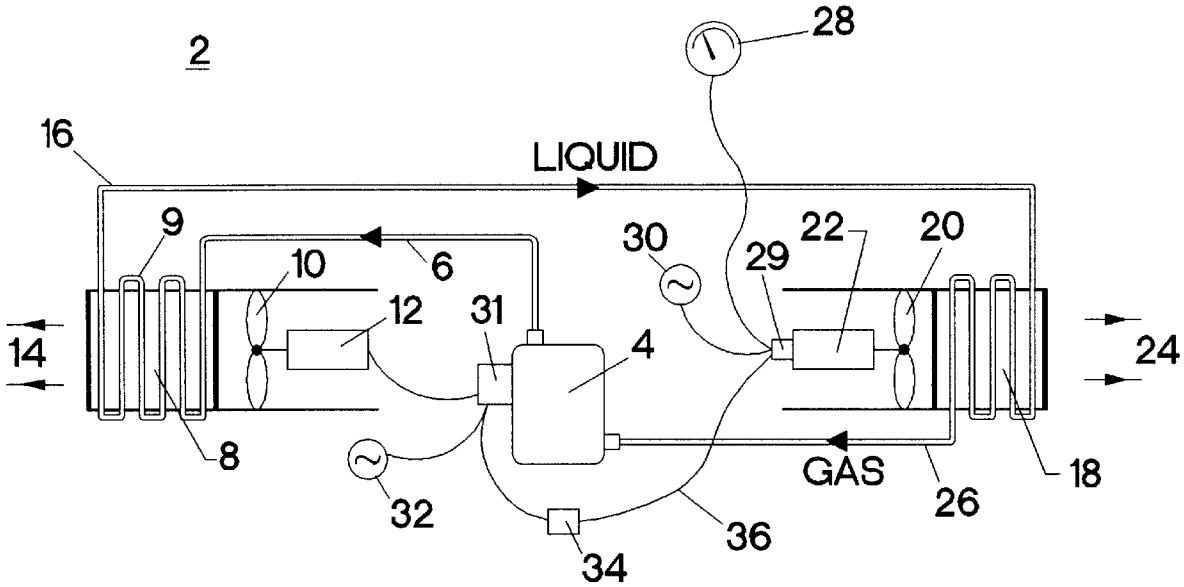
FIG. 1A is a diagrammatic representation of a typical refrigeration systems, using Thermostat control.

FIG. 1A, shows a refrigeration system, generally designated 2, which includes the present invention. The system comprises a compressor 4, which pumps high pressure gas through high pressure pipe 6 to condenser 8. Fan 10 is propelled by motor 12, and drives air 14 across condenser 8 to cool the condenser coils 9, and the gas therein, causing the gas to condense to liquid and give up its heat of condensation. Through the length of the condenser 8, large amounts of heat are lost to cooling air 14, which brings down the temperature and heat content of the media leaving the condenser, bringing said media to a liquid state. The liquid media is driven by pressure and it flows from condenser 8 through liquid pipe 16.

Liquid media flows along the liquid pipe 16, to evaporator 18, where fan 20, driven by motor 22, drives hot air 24 to be cooled by the evaporator 18. The liquid media from liquid pipe 16, in evaporator 18 absorbs heat from the air 24, and the media evaporates, absorbing the heat of evaporation, and exits along low pressure gas pipe 26, returning to compressor 4, which again drives it through its cycle via high pressure gas pipe 6.

Energy value sensor, thermostat 28 controls fan motor 22, by closing a relay 29 between current source 30 and fan motor 22. Absent the invention, thermostat 28 would simultaneously close relay 31 between current 32 and compressor 4, so that current could flow across relay 31 and would actuate power compressor 4.

However, control apparatus 34 of the present invention interrupts the connection 36, which provides voltage to relay 31, and thereby prevents the compressor 4 from turning on. This results in a delay, which is controlled according to the program outlined further below.

Figure 1B:
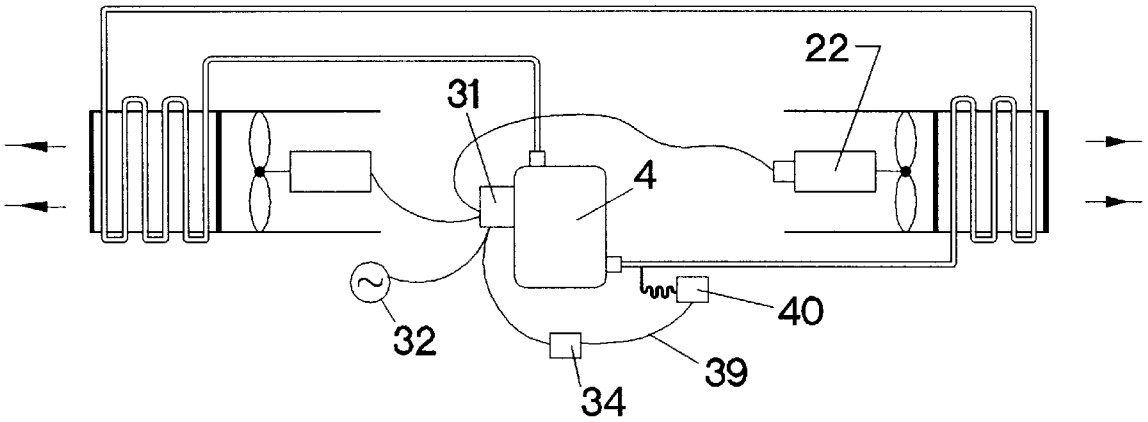
FIG. 1B is a diagrammatic representation of a typical refrigeration systems, using pressure control.

In FIG. 1B, control apparatus 34 is interposed in the wire 39 between the compressor 4 and energy value sensor, which is pressuretrol 40. Pressuretrol 40 is typically found as the temperature equivalent sensor on a refrigeration unit. A program also provides an appropriate delay to increase efficiency.

Figure 2:
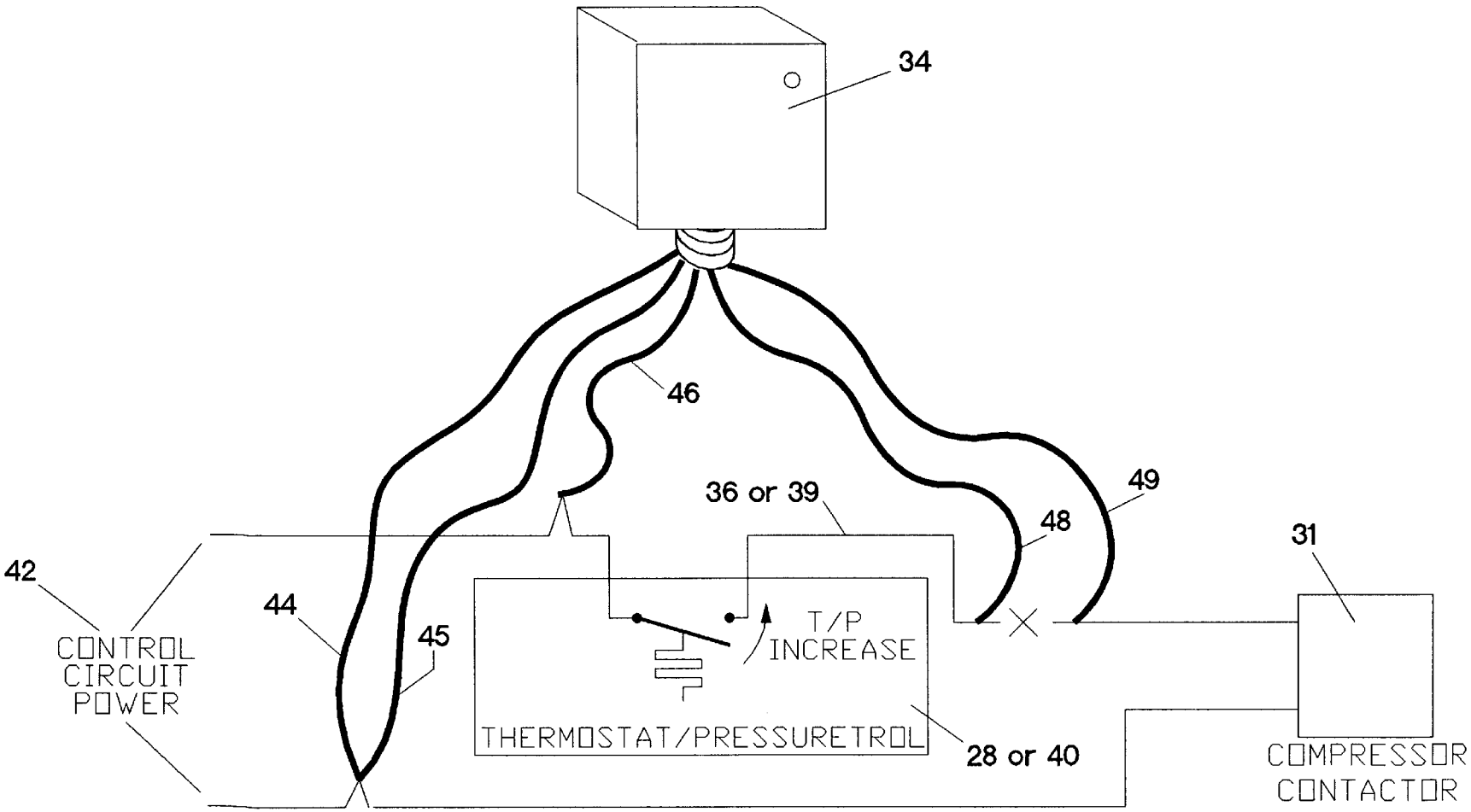
FIG. 2 is a typical installation wiring diagram.

FIG. 2 is a typical installation wiring diagram which shows a control unit 34 of the present invention, wired into the cooling circuit. FIG. 2 shows control circuit power 42, which may be 230, 115 or 24 volts AC in the embodiment shown depending on which contact 44*a, b*, or *c* it is attached to. Wires 44–46 supply control circuit power to control unit 34.

The same voltage is supplied across existing thermostat 28 or pressuretrol 40. Control wire 36 or 39 would provide control voltage to compressor contactor relay 31, but is broken so that yellow wire 48 and blue wire 49 insert control unit 34 into the circuit to prevent the compressor from operating until an appropriate delay has intervened.

Figure 3:
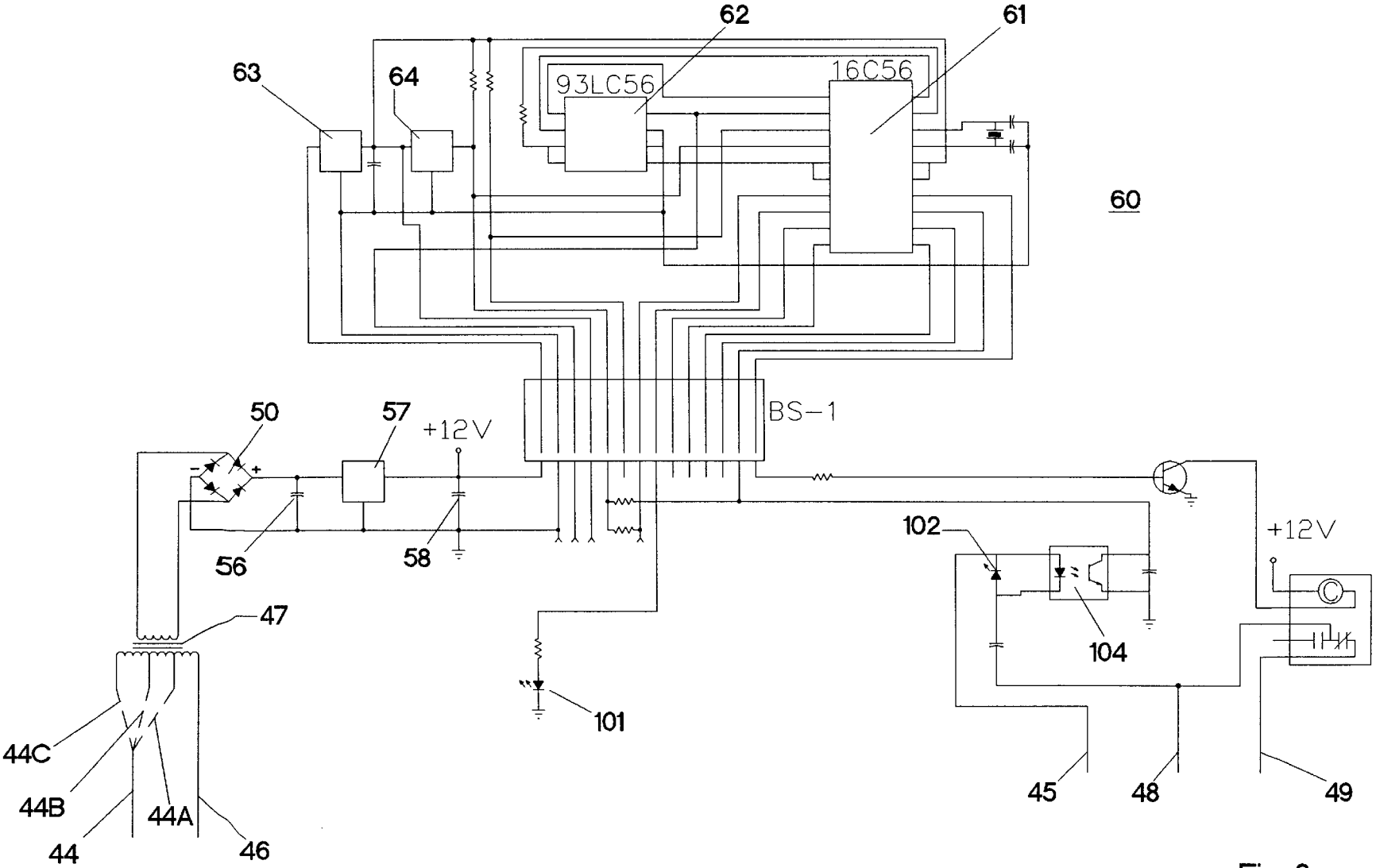
FIG. 3 is an electronic schematic.

FIG. 3 is a more detailed circuit diagram of the control unit 34. AC power is supplied by wires white 44 and brown 46 to transformer 47, then to rectifier 50, comprising four ring diodes, which rectifies the AC to DC. Approximately 14 volt DC is output across smoothing capacitor 56 to voltage regulator 57 across bypass capacitor 58 to pin 1 of BS-1. BS-1 distributes 12 volts DC to control circuit 60 and its micro-controller chips 61 and memory 62 via voltage regulating chip 63 and power-on reset chip 64. Light Emitting Diode 101 (LED) indicates mode status. LED 102 indicates if an energy value sensor is calling for compressor. Optoisolator 104 provides a sensor call to the controller over a wide range of possible call voltages, making this unit well suited for a variety of cooling systems.

Figure 3A:
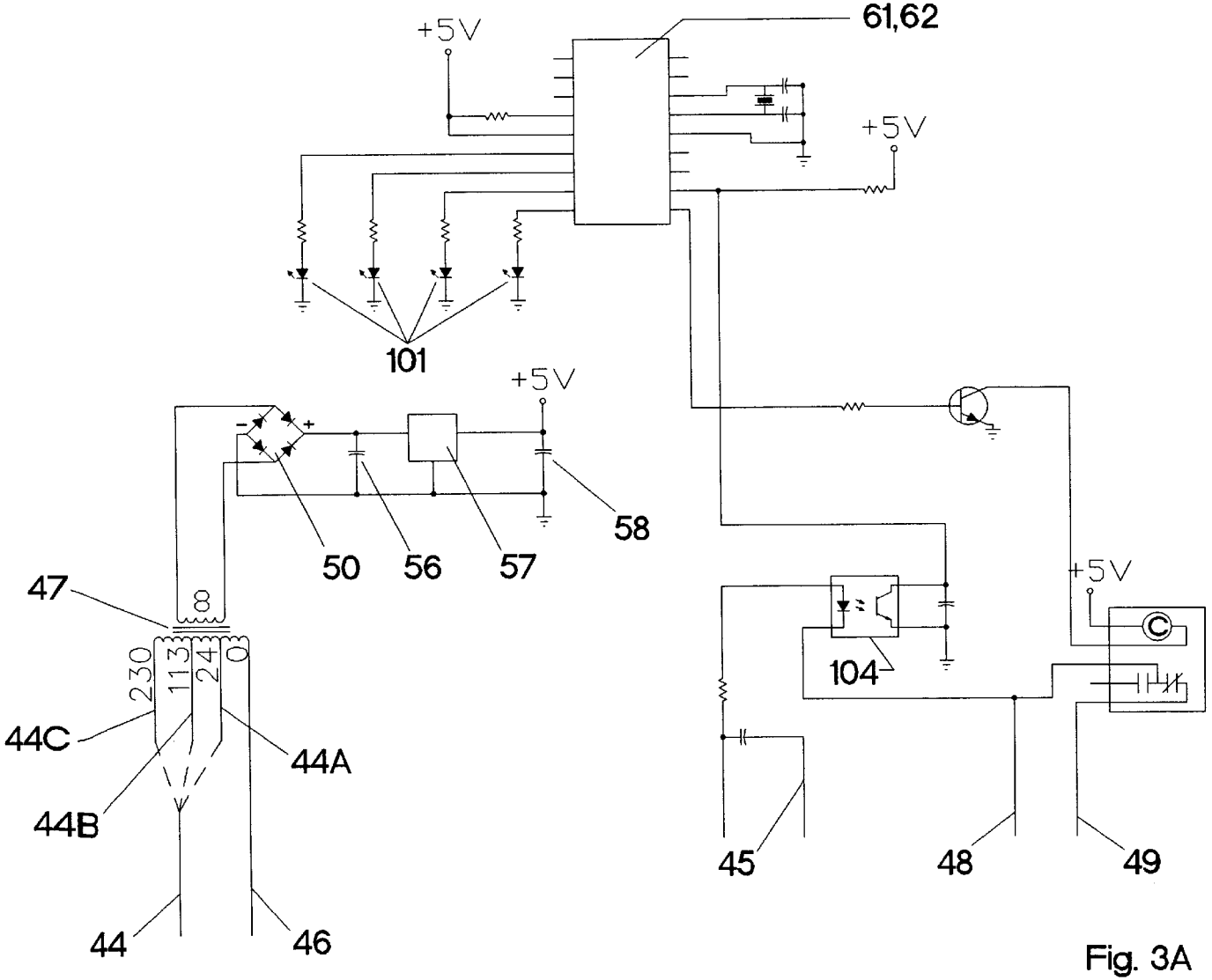
FIG. 3A is another embodiment of the schematic of FIG. 3.

While the units presently being tested are shown in FIG. 3, the inventor has constructed a unit using fewer of the chips which are now available. Cost may vary but the units are electronically equivalent, where a single chip replaces chips 61 and 62, and chips 63 and 64 are eliminated. See FIG. 3A. Further variations may be constructed by appropriately using component manufacturers' specifications to create equivalents. It will be understood that the best mode of constructing the controller will vary with the availability and capability of new chip designs.

Controller 34 operates according to the computer program at the end of this specification, entitled "COOLING ROUTINE".

The program incorporates a 180 second anti-short-cycling delay to always avoid starting the compressor within 180 seconds of compressor shut down. This is sufficient time to reduce undue stress on the compressor, as well as much greater than normal electrical demands, due to locked-rotor conditions, by allowing pressure-equalization within the compressor. A 180 second rest reduces excess heat buildup in the motor windings which heat can be caused by repeated rapid starting of the compressor. An anti-short-cycling algorithm tests off-time against the program constant MINOFFTIME, before allowing the compressor to start.

If the compressor off-time has been greater than 1 hour, the compressor is started immediately upon a call for cooling, the counter is reset, and a new count begins.

If off-time has not been greater than an hour, the delay is calculated as 10% of the last off time, and a countdown for that interval from the sensor call continues. Once the countdown ends, the compressor relay actuates the compressor, and a new timecount starts.

The compressor continues running until:

the sensor call ends, which starts a new off-time count; or a substantial run time elapses, sufficient to bring the space to be cooled to equilibrium, such as an hour, at which time the compressor is given a short rest, but sufficient to allow compressor pressure equalization and compressor motor cooling, such as a 6 minute rest, before restarting.

Figure 4:
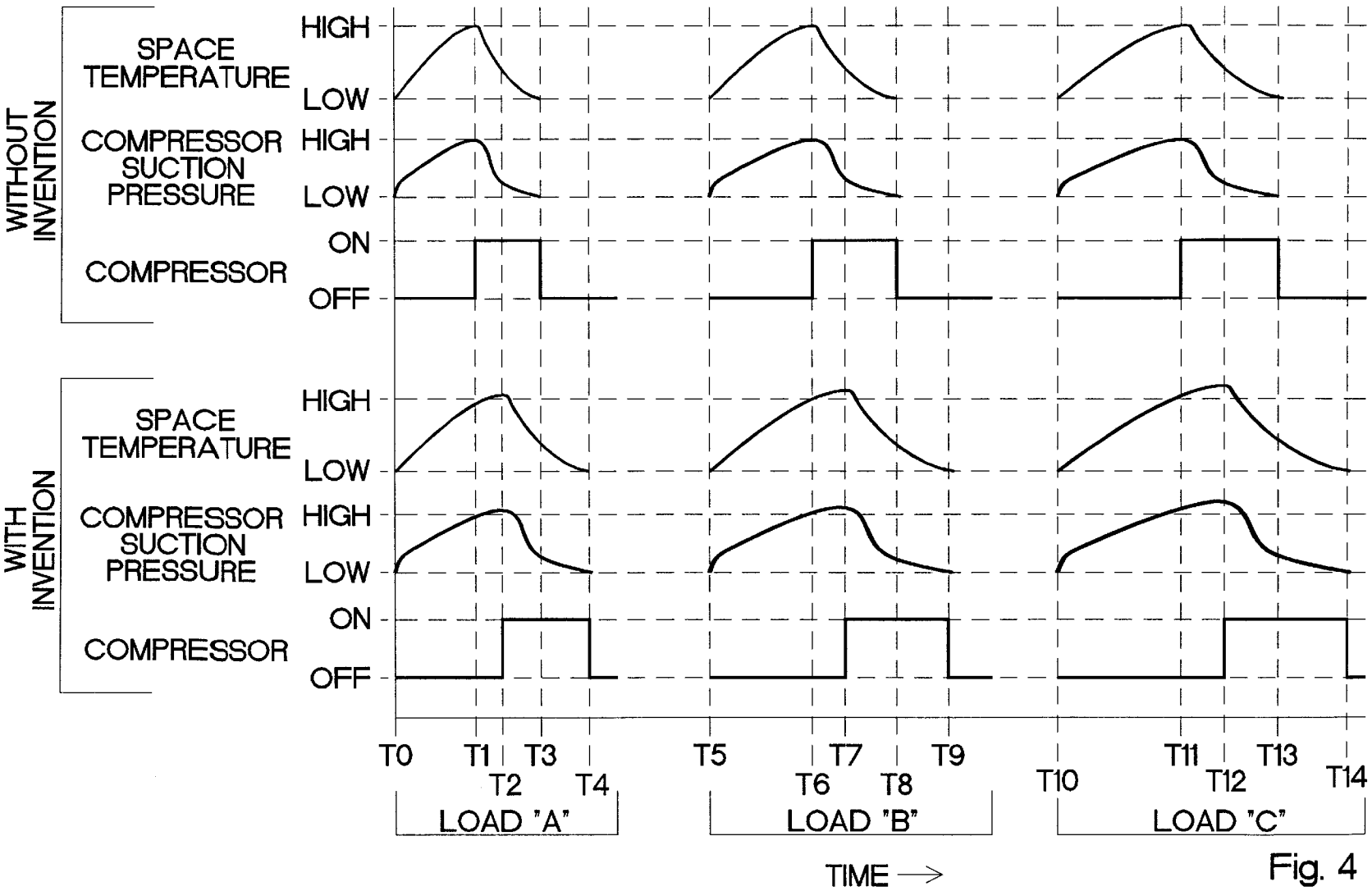
FIG. 4 is a chart graphing system vs. load characteristics with and without the invention.

FIG. 4 graphs the difference between:

standard compressor on/off time cycles, and the compressor on/off time cycles with the present invention, under three different load conditions: loads A, B, and C.

These graphs also show the response of the compressor to varying temperature or pressure depending on whether the cooling system is controlled by a thermostat or a pressuretrol.

Without the invention T1, T6 and T11 represent points on the temperature or pressure graphs that correspond to points when the compressor is started. T3, T8 and T13 correspond to the temperature or pressure levels when the compressor is stopped.

With the invention T2, T7, and T12 correspond to the new temperature or pressure compressor start points. T4, T9 and T14 correspond to the respective longer intervals before the compressor stop points. T0–T1, T5–T6 and T10–T11 are the time intervals from the last compressor shut-down to a point when there is a need for cooling, hereinafter the off-call-time.

T0–T2, T5–T7, and T1–T12 are the new off-intervals required due to the invention, including the invention's extended off-intervals of T1–T2, T6–T7 and T11–T12.

Figure 5:
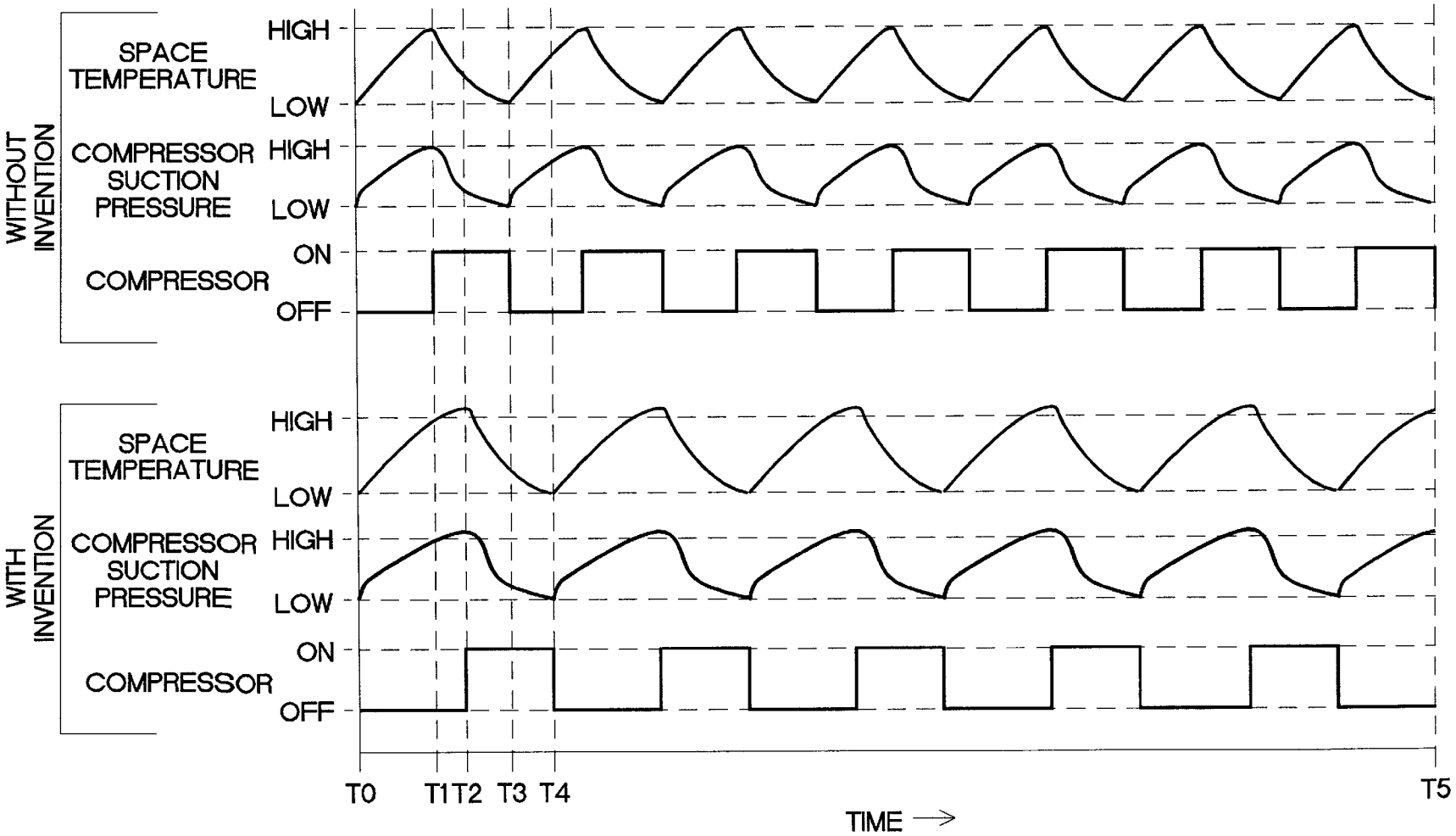
FIG. 5 is a chart graphing compressor cycling pattern for given load, with and without the invention, portraying cycle reduction with the invention.

FIG. 5 graphs the effect of a load, over seven cycles of a conventional cooling system, without the present invention (top). As can be seen on the bottom of FIG. 5, the same load is handled in only five on-cycles, with reduced on-time, with the present invention. Temperature excursions beyond the high point are insignificant and brief. The graph also illustrates the compressor response either to temperature or cooling media pressure, depending on whether the energy value sensor is a thermostat or a pressuretrol.

Where T1 represents the compressor turn-on point along the temperature or pressure curves without the invention, T2 represents the new turn-on point and includes the extended off-time T1–T2, with the invention, T3 corresponds to the turn-off point of the temperature or pressure curves without the invention; T4 with the invention.

Figure 6:
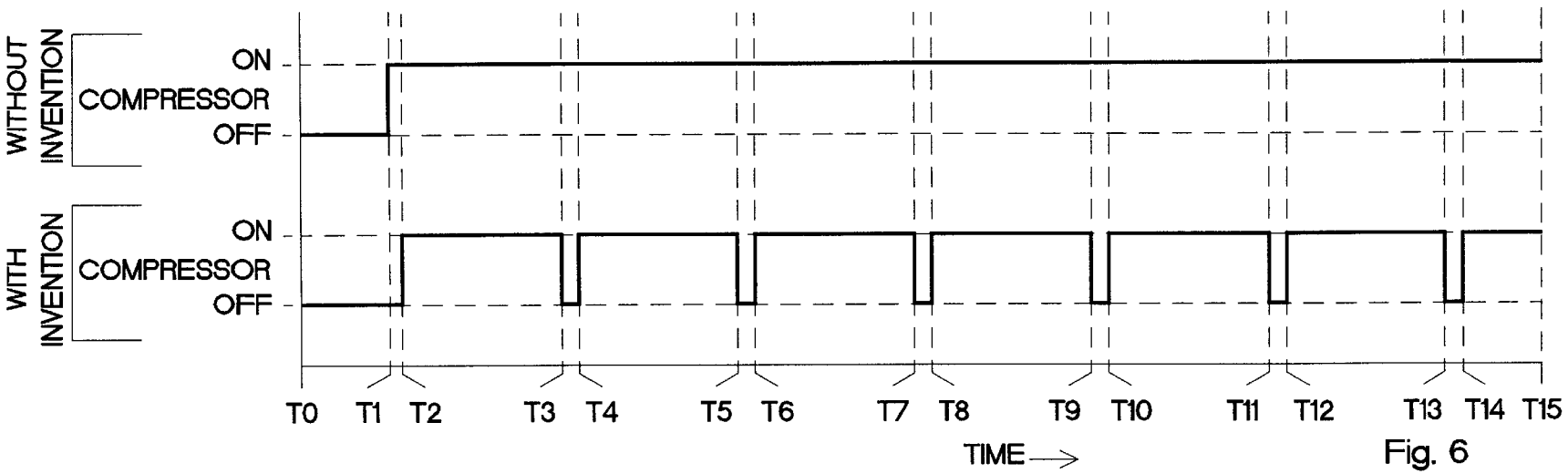
FIG. 6 is a chart graphing compressor cycle pattern with and without the invention illustrating the maximum on-time effect of the invention on the compressor cycling when the compressor would not normally cycle.

FIG. 6 graphs a saturation load. Without the invention, the compressor runs continuously. The invention gives the compressor a 6 minute rest (T3–T4; T5–T6; etc.) every 54 minutes (T2–T3, T5–T6, etc.), to cool down, to save energy in the brief off-time. Temperature (not graphed) is largely unaffected by this rest period.

Figure 7:
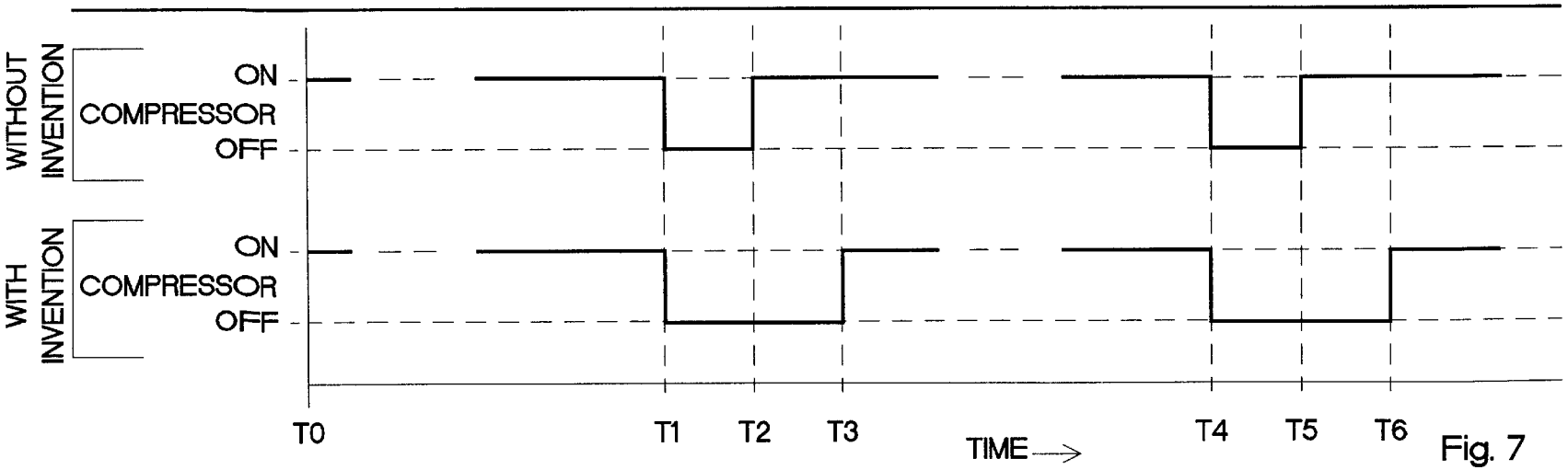
FIG. 7 is a chart graphing compressor cycles with and without the invention, displaying the effect of the anti-short-cycling algorithm.

FIG. 7 graphs a short cycle restart without the invention. The T1–T2 interval is too short to equalize compressor pressure or to cool the motor coils. A severe and power consuming electrical load results, that might even burn out the motor.

With the invention, the short compressor off-time (T1–T2) is extended by T2–T3 to an adequate 3 minutes (T1–T3), resulting in an easier starting load on the motor.

All the above time values are optimized in this presently preferred embodiment, but it will be appreciated that advantages of this invention can be achieved in spite of various departures from the above time and percentage values.

```
'COPYRIGHT 1997 JACK N. HAMMER
'
'
'
'THERMOMI$ER PROGRAM
'COOLING ROUTINE
'12/27/96
'
'rev 1
'6/19/97 changed from 2 leds to 1
'rev 2
'8/29/97 added max ON-TIME, OFF-TIME, OFF TIME, AND ANTI SHORT-CYCLING.
'
'*************************************SYMBOLS - CONSTANTS*******************************
SYMBOL TRUE = 1
SYMBOL FALSE = 0
SYMBOL ON = 1
SYMBOL OFF = 0
SYMBOL NOT_ON = 0
SYMBOL NOT_OFF = 1
SYMBOL FLAG_REG = B0                'FLAG BYTE, CONTAINS BITS B0 - B7
SYMBOL COUNT = BIT0                 'USED AS A SECOND (TIME) GENERATOR XOR'D WITH 1
SYMBOL MULTCNT = BIT1               'set when a percent delay has been calculated
SYMBOL DWNCNTFLAG = BIT2            'set when counting down for delay
SYMBOL MINOFFFLAG = BIT3 'rev2 -- flag for anti-short-cyclind set when ok to run
'SYMBOL BYPASSFLAG = BIT4           'not used
SYMBOL LED1 = PIN1                  'pin used to control led
'SYMBOL LED2 = PIN2 'rev.1
SYMBOL CALL4COOLIN = PIN6           'input sense when call for compressor
SYMBOL COOLOUT = PIN7               'relay control pin
SYMBOL COUNTER = W1                 'reg used for counting up & down
SYMBOL PERCOUNTER = W2              'temp reg for percent calculation
SYMBOL MULTLIM = W3                 'reg used for multiplier upper limit
SYMBOL PERCENT_DELAY = 10           'used for delay time mutiplyer factor
SYMBOL OFFTIME = 360 'rev2 -- 360 forced off cycle time
```

-continued

```
SYMBOL MAXONTIME = 3240 'rev2 -- max on time (seconds) before forcing off
SYMBOL MAXOFFTIME = 3600 'rev2 -- max off time (seconds) causing instant on
SYMBOL MAXCOUNTER = W4 'rev2 -- word used for on-time counter
SYMBOL MINOFFTIME = 180 'rev2 -- 180 anti-short cycling time delay
'INITIALIZE VARIABLES
DIRS=%10000110                    'SETS PINS 1,2 AND 7 FOR OUTPUT
COOLOUT = NOT_OFF 'ENERGIZES RELAY
COUNTER = 0: PERCOUNTER = 0 'RESETS FLAGS TO KNOWN STATE
MAXCOUNTER = 0 'rev2 - set to known value
MULTLIM = 65535 / PERCENT_DELAY   'set multlim to value, used in off time
calculation
FLAG_REG = FALSE                  'resets all flags
PAUSE 450                         'delay
'*****************************************main routine*****************************************
MAIN:
PAUSE 450                         'loop time delay used for timing
COUNT = COUNT ^ 1 'generates seconds
IF CALL4COOLIN = NOT_ON AND MINOFFFLAG = TRUE THEN MAINTEST' rev2
' rev2 IF CALL4COOLIN = NOT_ON THEN MAINTEST
MINOFFFLAG = FALSE' rev2
IF DWNCNTFLAG = TRUE THEN ZEROCNTR
COOLOUT = NOT_OFF
'LED1 = ON 'rev.1
'LED2 = OFF 'rev.1
'led1 = off 'rev.2
led1 = call4coolin ^ 1' rev2 reverses led blink during anti short cycle
pulsout 1,5000                    'pulses led
MULTCNT = FALSE
GOSUB COUNTUP                     'counts up during comtressor off time
GOTO MAIN
'******************************************** main test ************************************
'this loop is jumped to when there is a need for cooling
MAINTEST:
IF COUNTER>MAXOFFTIME THEN STARTNOW 'rev2 -- if greater than 1 hr. start
IF MULTCNT = FALSE THEN MULTIPLY  'tests for delay calculation
IF MAXCOUNTER>MAXONTIME THEN OFFCYCLE 'rev2 -- tests for long on-time
IF COUNTER = 0 THEN COOLON        'if delay has expired, start compressor
GOSUB COUNTDWN                    'counts down when in delay mode
GOTO MAIN
'*****************************************************************************************
'calculates delay time
MULTIPLY:
MULTCNT = TRUE
IF COUNTER > MULTLIM THEN MULTIPLY2 'this makes sure that the result can not
exceed 65535
PERCOUNTER = COUNTER * PERCENT_DELAY / 100
COUNTER = PERCOUNTER
GOTO MAIN
MULTIPLY2:
PERCOUNTER = COUNTER / 100 * PERCENT_DELAY
COUNTER = PERCOUNTER
GOTO MAIN
COOLON:
COOLOUT = NOT_ON
rem LED1 = OFF
rem LED2 = ON
led1 = on
GOSUB MAXTIMECOUNT 'rev2
GOTO MAIN
ZEROCNTR:
DWNCNTFLAG = FALSE
COUNTER = 0
GOTO MAIN
COUNTUP:
IF MINOFFFLAG = FALSE AND COUNTER > MINOFFTIME THEN SETMINOFFFLAG 'rev2
COUNTER = COUNTER + COUNT MAX 65534
RETURN
SETMINOFFFLAG:
MINOFFFLAG = TRUE
GOTO COUNTUP:
COUNTDWN:
DWNCNTFLAG = TRUE
LED1 = COUNT
COUNTER = COUNTER - COUNT
COUNTER = COUNTER MIN 0
PAUSE 50
RETURN
MAXTIMECOUNT: 'rev2
MAXCOUNTER=MAXCOUNTER + COUNT 'rev2
RETURN 'rev2
```

-continued

```
OFFCYCLE: 'rev2
COOLOUT = NOT_OFF 'rev2
COUNTER = OFFTIME 'rev2
MAXCOUNTER = 0 'rev2
led1 = OFF 'rev2
GOTO MAIN 'rev2
STARTNOW: 'rev2 causes compressor on by putting counter to 0 and multcnt
COUNTER = 0 ' true. this fools the program into thinking that the unit
MULTCNT = TRUE ' went thru a normal cycle.
GOTO MAINTEST 'rev2
```

I claim:

1. A method of regulating a cooling system operation comprising the steps of:

measuring an off-call-time of a compressor control circuit;

sensing a compressor call from a energy value sensor; and preventing the operation of the compressor for an interval which is a value derived from the measured off-call-time.

2. A method according to claim 1 in which operation of the compressor is prevented unless and until the off-call-time exceeds a predetermined value, which value allows for substantial compressor pressure equalization.

3. A method according to claim 1 further comprising the steps of:

storing the off-call-time last measured in a memory;

calculating a percentage of the off-call-time;

preventing compressor operation for a delay equal to the percentage; and operating the compressor subsequent to the delay.

4. A method according to claim 1 further comprising the steps of:

measuring an on-cycle of compressor operation time;

stopping operation of the compressor after the on-cycle has extended for a substantial on-time interval; and the step of interrupting operation of the compressor is for a measured off-time of a rest interval, which rest interval is short but sufficient to allow:

compressor equalization, compressor motor cooling, and efficiency resulting from a rest interval, which is brief, during which a space temperature is substantially maintained by a thermal inertia of any cooled objects and fluids in the space.

5. A method according to claim 1 wherein, if the compressor off-call-time has been greater than a maximal value, the interval is substantially zero.

6. A method according to claim 5, in which the maximal value is substantially an hour.

7. A method of regulating a cooling system operation comprising the steps of:

monitoring a value from an energy value sensor;

determining from said value whether the value warrants a call for compressor operation;

generating a call when warranted;

measuring an off-call-time prior to said call from a previous compressor shut down;

storing the off-call-time last measured in a memory;

delaying operation of the compressor if the off-call-time is less than a short-cycle interval which short-cycle interval would allow substantial compressor pressure equalization;

calculating a percentage of the off-call-time;

preventing compressor operation for a delay equal to the percentage;

operating the compressor subsequent to the delay;

measuring an on-cycle of compressor operation time;

interrupting operation of the compressor after the on-cycle has extended for a substantial interval sufficient to bring a space to an equilibrium temperature; and preventing operation of the compressor for a predetermined rest interval, which rest interval is short but sufficient to allow:

compressor equalization, compressor motor cooling, and improving efficiency by saving energy during the rest interval, during which rest interval a thermal inertia of any cooled objects and fluids in the space substantially maintains a temperature in the space.

8. A method according to claim 7 in which a following set of optimal values are substantially used:

the short cycle interval is three minutes;

the percentage is ten percent;

the substantial interval is 54 minutes; and the rest interval is 6 minutes.

9. In a cooling system comprising a compressor, a cooling media, and a heat exchanger, an improvement comprising:

an energy value sensor; and means:

for monitoring the energy value sensor, for controlling the compressor, for determining the thermal load on the cooling system by measuring an off-call-time of a compressor control circuit, for receiving a compressor call from the energy value sensor, and for preventing the energy value sensor from running the system compressor for an interval which is a value derived from the measured off-call-time.

10. Apparatus according to claim 9, in which the controlling means includes:

a break in a power supply wire between:

the energy value sensor, and the compressor; and means for switchably bridging said break.

11. Apparatus according to claim 10 in which the means for monitoring the energy value sensor comprises:

a hot wire switched on by the energy value sensor in response to an energy value at which the space requires more cooling; and switch means for actuation by a voltage on the hot wire.

12. Apparatus according to claim 11 in which the switch means for actuation by a voltage on the hot wire is an electronic circuit for sensing a wide range of voltage inputs.

13. Apparatus according to claim 12 in which the wide range of voltage inputs is between 24 VAC and 240 VAC.

14. Apparatus according to claim 12 in which the electronic circuit comprises an optoisolator.

15. Apparatus according to claim 12 in which the electronic circuit comprises a microcontroller.

16. Apparatus according to claim 15 in which the improvement serves as a means:

for increasing a run-time per cycle of the compressor, and thereby for improving electric utilization and for decreasing a total run-time of the compressor.

17. Apparatus according to claim 9 in which the energy value sensor is a thermostat.

18. Apparatus according to claim 9 in which the energy value sensor is a pressuretrol.

19. Apparatus according to claim 10 in which the switch means is in a normally closed position so that, if the power supply or controller fail, the cooling system still operates.

* * * * *